US011051594B1

(12) United States Patent
Eigenman

(10) Patent No.: US 11,051,594 B1
(45) Date of Patent: Jul. 6, 2021

(54) MAGNETIC BEADS

(71) Applicant: Shannon Renee Eigenman, Hanford, CA (US)

(72) Inventor: Shannon Renee Eigenman, Hanford, CA (US)

( * ) Notice: Subject to any disclaimer, the term of this patent is extended or adjusted under 35 U.S.C. 154(b) by 134 days.

(21) Appl. No.: 16/512,354

(22) Filed: Jul. 15, 2019

Related U.S. Application Data

(60) Provisional application No. 62/713,974, filed on Aug. 2, 2018.

(51) Int. Cl.
*A44C 25/00* (2006.01)

(52) U.S. Cl.
CPC ..... *A44C 25/007* (2013.01); *A44D 2203/00* (2013.01)

(58) Field of Classification Search
CPC ..... A44C 25/007; A44C 15/00; A44C 17/208; A44C 17/0216; A44D 2203/00
USPC ..... 63/21, 23, 29.2; 24/115 R
See application file for complete search history.

(56) References Cited

U.S. PATENT DOCUMENTS

| | | | | |
|---|---|---|---|---|
| 5,050,276 | A | 9/1991 | Pemberton | |
| 5,195,335 | A | 3/1993 | Hart | |
| 5,214,940 | A | 6/1993 | Capifali | |
| 5,722,260 | A | 3/1998 | Mangano | |
| 6,962,063 | B1 | 11/2005 | Pearl | |
| 7,316,130 | B2 | 1/2008 | Morkenborg | |
| 7,779,517 | B1 | 8/2010 | Stewart | |
| 8,640,266 | B2 | 2/2014 | Best | |
| 8,761,430 | B2 | 6/2014 | Zimmerman | |
| 2003/0056423 | A1* | 3/2003 | Baucom | A01K 85/00 43/42.39 |
| 2006/0230785 | A1 | 10/2006 | La Belle | |
| 2008/0083248 | A1 | 4/2008 | Wang | |
| 2011/0239702 | A1 | 10/2011 | Best | |
| 2012/0111053 | A1 | 5/2012 | Huynh | |
| 2012/0233741 | A1* | 9/2012 | Watson | A44B 99/00 2/207 |
| 2014/0209116 | A1 | 7/2014 | Seibt | |
| 2014/0237891 | A1* | 8/2014 | Donahoe | A01K 95/02 43/44.87 |
| 2015/0020543 | A1 | 1/2015 | Kaupp | |
| 2015/0074954 | A1* | 3/2015 | Pruitt | A44C 5/2071 24/303 |
| 2016/0219990 | A1 | 8/2016 | Wilder | |
| 2017/0135899 | A1 | 5/2017 | Milkowski | |
| 2017/0136256 | A1 | 5/2017 | Dinh | |

* cited by examiner

*Primary Examiner* — Jack W Lavinder
(74) *Attorney, Agent, or Firm* — Quickpatents, LLC; Kevin Prince

(57) ABSTRACT

An accessory for an elongated cord or fabric includes front and back portions that each have at least a front side, a rear side, a top side, and a bottom side. The rear sides each include a groove extending from the top side to the bottom side. The grooves are cooperative such that when the rear side of the front portion contacts the front side of the back portion, the two grooves together form a channel through which the at least one elongated cord traverses. A magnetic latch is fixed between the rear side of the front portion and the front side of the back portion, such that the front and back portions are mutually magnetically attractive, and attached either around the at least one elongated cord or by capturing a portion of fabric therebetween.

10 Claims, 4 Drawing Sheets

MAGNETIC BEADS

CROSS-REFERENCE TO RELATED APPLICATIONS

This application claims the benefit of U.S. Provisional Patent Application 62/713,974, filed on Aug. 2, 2018, and incorporated herein by reference.

STATEMENT REGARDING FEDERALLY SPONSORED RESEARCH AND DEVELOPMENT

Not Applicable.

FIELD OF THE INVENTION

This invention relates to clothing accessories, and more particularly to magnetic beads for fastening to cords and fabric.

DISCUSSION OF RELATED ART

Pins and traditional magnetically-attached accessories are well known for accessorizing clothing, footwear, headwear, and the like. However, often garments and other accessories like hats and boots have elongated cords or straps that are difficult to accessorize. It is not always desirable to use an accessory that has a pin attachment means since the pin can leave a small, but sometimes still obvious, hole in the object. Yet it is difficult to secure a traditional magnetic accessory around a cord or strap with much reliability.

Therefore, there is a need for an accessory device that quickly allows a user to attach an attractive accessory item to either straps, cords, or fabric. Such a needed invention would provide an attractive accessory that holds firmly in place where set, and would not damage the item to which it is attached. Such a needed device would be relatively inexpensive to manufacture and intuitive to use. The present invention accomplishes these objectives.

SUMMARY OF THE INVENTION

The present device is an accessory for an elongated cord, such as may be found on a garment, shoe, jewelry, or the like. The accessory may also be used with fabric such as from a garment, or the like.

A front portion has at least a front side, a rear side, a top side, and a bottom side. The rear side includes a groove extending from the top side to the bottom side. In some embodiments, an adornment is fixed with the front side of the front portion, either with a mechanical fastener, adhesive, or the like.

Similarly, a back portion has at least a front side, a rear side, a top side, and a bottom side. The rear side includes a groove extending from the top side to the bottom side. The groove of the back portion is cooperative with the groove of the front portion such that when the rear side of the front portion contacts the front side of the back portion, the two grooves together form a channel through which the at least one elongated cord traverses.

A magnetic latch is fixed between the rear side of the front portion and the front side of the back portion, such that when the front and back portions are brought within mutual proximity the magnetic latch magnetically attracts and attaches the front and back portions together, either around the at least one elongated cord or by capturing a portion of fabric therebetween. As such, the accessory is magnetically fixed with the cord or the fabric to hold the accessory in place.

In some embodiments the magnetic latch includes at least one magnet fixed with either the front portion or the back portion, and at least one magnetically-attractive metal object fixed with either the back portion or the front portion, respectively. The magnetically-attractive metal object may, in some cases, be another magnet. Such a magnet and magnetically-attractive metal object may be fixed within one of the grooves of either the front portion or the back portion, such that the at least one elongated cord is magnetically captured between the at least one magnet and the at least one magnetically-attractive metal object. Alternately, the front portion and/or the back portion may be themselves made from a magnetic material such that they are mutually magnetically attracted. That is, the front portion and the back portion may essentially include the at least one magnet integrally formed therewith.

Preferably an outline of the back portion is a mirror image of an outline of the front portion. As such, when mated together the front and back portions provide a smooth seam therebetween.

The present invention is an accessory device that quickly allows a user to attach an attractive accessory item to either a strap, cord, or fabric. The present invention provides an attractive accessory that holds firmly in place where set, and that does not damage the item to which it is attached. The present device is relatively inexpensive to manufacture, can be made in an endless variety of shapes, colors and designs, and intuitive to use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
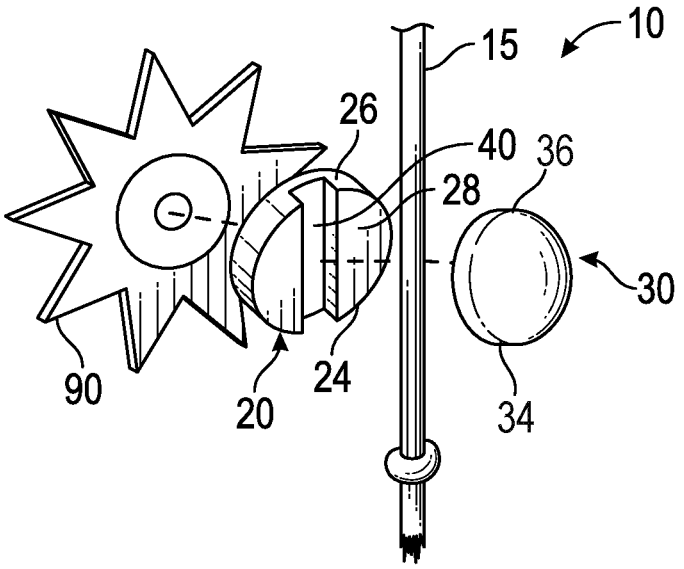
FIG. 1 is an exploded view of the invention.
Figure 2:
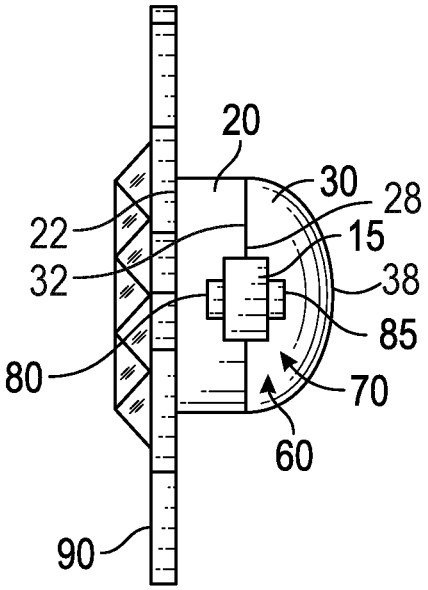
FIG. 2 is a top plan view of the invention, illustrated as attached to an elongated cord.
Figure 3:
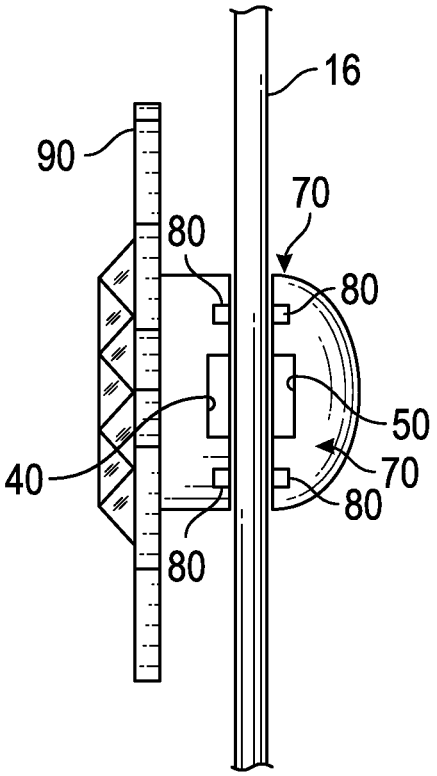
FIG. 3 is a top plan view of the invention, illustrated as attached to a portion of fabric.
Figure 4:
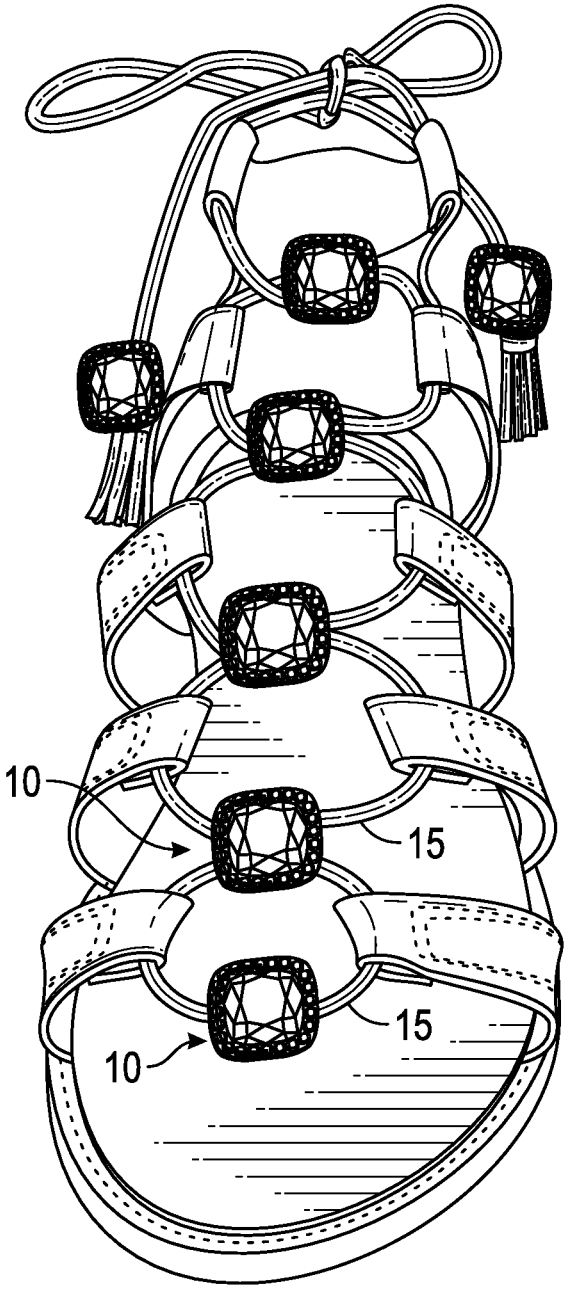
FIG. 4 is a top perspective view of the invention, illustrated as attached to elongated cords of a sandal.
Figure 6:
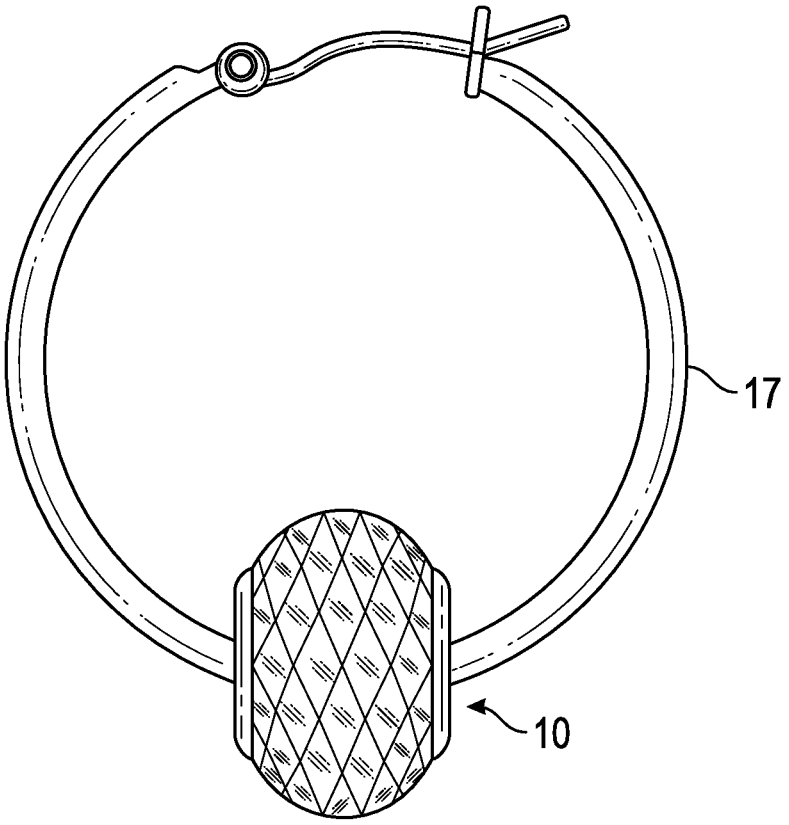
FIG. 6 is a front elevational view of the invention, illustrated as attached with an earring.

FIGS. 1-3 illustrate an accessory 10 for an elongated cord 15, such as may be found on a garment, shoe (FIG. 4), jewelry 17 (FIG. 6), or the like. The accessory 10 may also be attached to fabric such as from a garment, or the like, and is a two-part accessory 10.

A front portion 20 has at least a front side 22, a rear side 28, a top side 26, and a bottom side 24. The rear side 28 includes a groove 40 extending from the top side 26 to the bottom side 24. The front portion 20 is preferably made with materials that include plastic, metal, wood, ceramics, epoxy resin, or the like. Alternately, the front portion 20 may be made with non-rigid materials such as paper, vinyl or other flexible plastic sheet material, woven fabrics, non-woven fabrics, or the like. In some embodiments, an adornment 90 is fixed with the front side 22 of the front portion 20, either with a mechanical fastener, adhesive, or the like.

Similarly, a back portion 30 has at least a front side 32, a rear side 38, a top side 36, and a bottom side 34. The rear side 38 includes a groove 50 extending from the top side 26 to the bottom side 24. The groove 50 of the back portion 30 is cooperative with the groove 40 of the front portion 20 such that when the rear side 28 of the front portion 20 contacts the front side 32 of the back portion 30, the two grooves 40,50 together form a channel 60 through which the at least one elongated cord 15 traverses. The back portion 30 is preferably made with materials that include plastic, metal, wood, ceramics, epoxy resin, or the like. Alternately, the back portion 30 may be made with non-rigid materials such as paper, vinyl or other flexible plastic sheet material, woven fabrics, non-woven fabrics, or the like. In either case, preferably the back portion 30 includes the same materials used to make the front portion 20.

Figure 5:
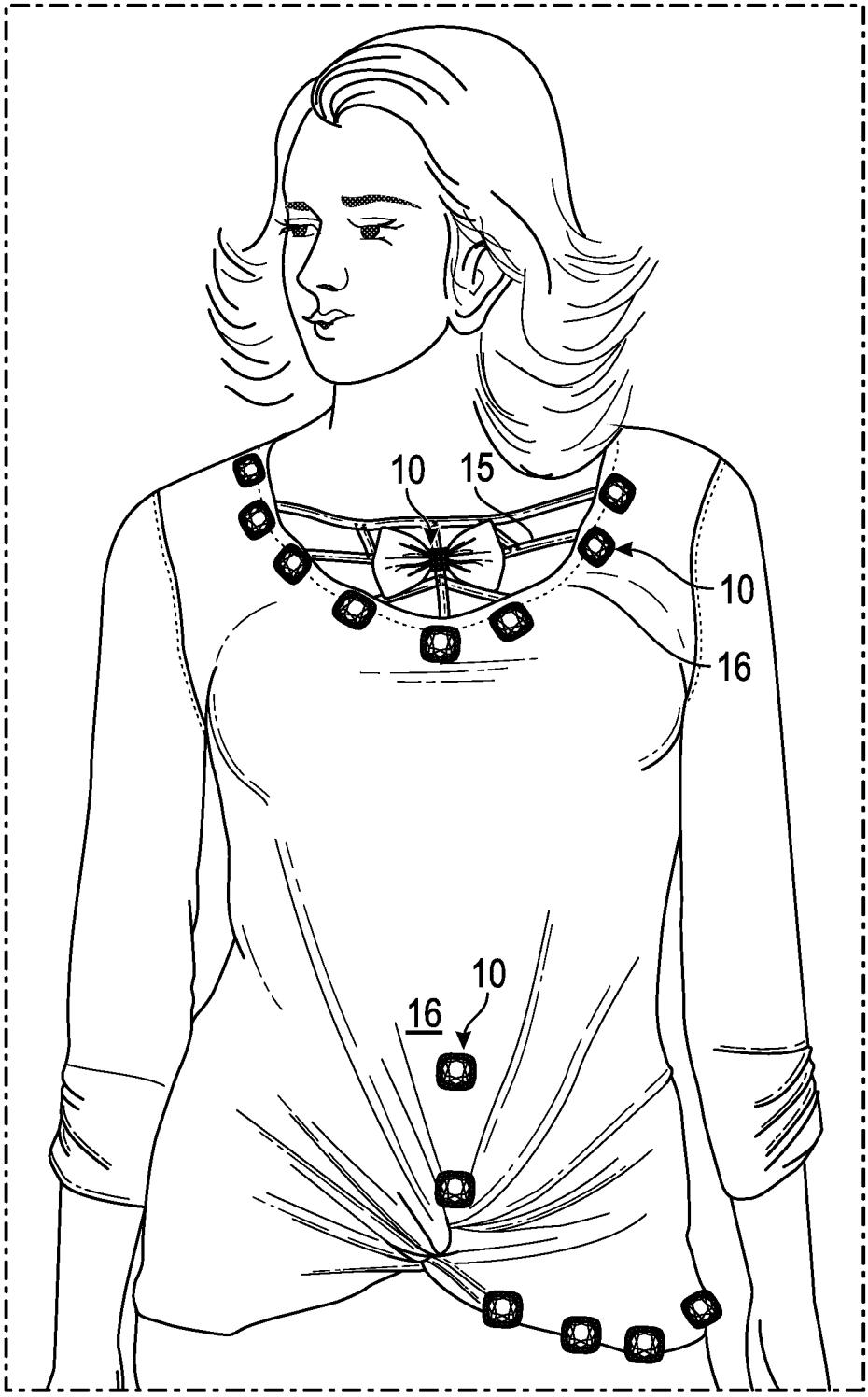
FIG. 5 is a front elevational view of the invention, illustrated as attached to a cord of a shirt as well as fabric of the shirt.

A magnetic latch 70 is fixed between the rear side 28 of the front portion 20 and the front side 32 of the back portion 30, such that when the front and back portions 20,30 are brought within mutual proximity the magnetic latch 70 magnetically attracts and attaches the front and back portions 20,30 together, either around the at least one elongated cord 15 or by capturing a portion of fabric 16 (FIG. 5), such as from a garment, therebetween. As such, the accessory 10 is magnetically fixed with the cord 15 or the fabric 16 to hold the accessory 10 in place.

In some embodiments the magnetic latch 70 includes at least one magnet 80 fixed with either the front portion 20 or the back portion 30, and at least one magnetically-attractive metal object 85 fixed with either the back portion 30 or the front portion 20, respectively. The magnetically-attractive metal object 85 may, in some cases, be another magnet 80. Such a magnet 80 and magnetically-attractive metal object 85 may be fixed within one of the grooves 40,50 of either the front portion 20 or the back portion 30, such that the at least one elongated cord 15 is magnetically captured between the at least one magnet 80 and the at least one magnetically-attractive metal object 85.

Alternately, the front portion 20 and/or the back portion 30 may be themselves made from a magnetic material such that they are mutually magnetically attracted. That is, the front portion 20 and the back portion 30 may essentially include the at least one magnet integrally formed therewith.

Preferably a perimeter outline of the back portion 30 is a mirror image of a perimeter outline of the front portion 20. As such, when mated together the front and back portions 20,30 provide a smooth seam therebetween.

While a particular form of the invention has been illustrated and described, it will be apparent that various modifications can be made without departing from the spirit and scope of the invention. For example, certain shapes of the accessory 10 have been illustrated in the figures, but the invention is not limited to those shapes or adornments as illustrated. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms.

Accordingly, the inventor reserves the right to add additional claims after filing the application to pursue such additional claim forms for other aspects of the invention.

What is claimed is:

1. An accessory for an elongated cord, the accessory comprising:

a front portion having at least a front side, a rear side, a top side, and a bottom side, the rear side including a groove extending from the top side to the bottom side;

a back portion having at least a front side, a rear side, a top side, and a bottom side, the front side including a groove extending from the top side to the bottom side and cooperative with the groove of the front portion such that when the rear side of the front portion contacts the front side of the back portion, the two grooves together form a channel through which the at least one elongated cord traverses; and a magnetic latch fixed between the rear side of the front portion and the front side of the back portion;

wherein the front portion and the back portion are both made from a non-rigid material taken from the group consisting of: paper, vinyl or other flexible plastic sheet material, woven fabrics, and non-woven fabrics;

whereby when the rear side of the front portion is brought into close proximity with the front side of the rear portion, the front portion is magnetically attracted to the back portion to capture the at least one elongated cord within the channel and to hold the accessory onto the at least one elongated cord.

2. The accessory of claim 1 wherein the magnetic latch includes at least one magnet fixed with either the front portion or the back portion, and at least one magnetically-attractive metal object fixed with either the back portion or the front portion, respectively.

3. The accessory of claim 2 wherein the at least one magnet and the at least one magnetically-attractive metal object are each fixed within one of the grooves of either the front portion or the back portion, such that the at least one elongated cord is magnetically trapped between the at least one magnet and the at least one magnetically-attractive metal object.

4. The accessory of claim 1 wherein the magnetic latch includes a plurality of magnets fixed with both the front portion and the back portion.

5. The accessory of claim 4 wherein the magnets are each fixed within one of the grooves of either the front portion or the back portion, such that the at least one elongated cord is magnetically trapped between the magnets.

6. The accessory of claim 1 wherein the front portion and the back portion are both made magnetic materials that are mutually attractive.

7. The accessory of claim 1 wherein an adornment is fixed with the front side of the front portion.

8. The accessory of claim 1 wherein the front portion and the back portion are both made from a rigid material taken from the group consisting of: plastic, metal, wood, ceramics, and epoxy resin.

9. The accessory of claim 1 wherein an outline of the back portion is a mirror image of an outline of the front portion such that the two portions when brought together form an uninterrupted surface.

10. An accessory for an elongated cord, the accessory comprising:

a front portion having at least a front side, a rear side, a top side, and a bottom side, the rear side including a groove extending from the top side to the bottom side, an adornment being fixed with the front side of the front portion;

a back portion having at least a front side, a rear side, a top side, and a bottom side, the front side including a groove extending from the top side to the bottom side and cooperative with the groove of the front portion such that when the rear side of the front portion contacts the front side of the back portion, the two grooves together form a channel through which the at least one elongated cord traverses; and a magnetic latch fixed between the rear side of the front portion and the front side of the back portion, the magnetic latch including at least one magnet fixed with either the front portion or the back portion, and at least one magnetically-attractive metal object fixed with either the back portion or the front portion, respectively;

wherein the front portion and the back portion are both made from a non-rigid material taken from the group consisting of: paper, vinyl or other flexible plastic sheet material, woven fabrics, and non-woven fabrics;

whereby when the rear side of the front portion is brought into close proximity with the front side of the rear portion, the front portion is magnetically attracted to the back portion to capture the at least one elongated cord within the channel and to hold the accessory onto the at least one elongated cord.

* * * * *